US007153052B2

(12) United States Patent
Nakayama et al.

(10) Patent No.: US 7,153,052 B2
(45) Date of Patent: Dec. 26, 2006

(54) WRITING IMPLEMENT

(75) Inventors: Kyo Nakayama, Yokohama (JP); Yoshiaki Makita, Tokyo (JP)

(73) Assignees: Mitsubishi Pencil Kabushikikaisha, Tokyo (JP); Geltec Co., Ltd., Tokyo (JP)

( * ) Notice: Subject to any disclaimer, the term of this patent is extended or adjusted under 35 U.S.C. 154(b) by 135 days.

(21) Appl. No.: 10/770,125

(22) Filed: Feb. 3, 2004

(65) Prior Publication Data

US 2004/0190973 A1 Sep. 30, 2004

(30) Foreign Application Priority Data

Feb. 5, 2003 (JP) ..... 2003-028526
Jun. 13, 2003 (JP) ..... 2003-168722

(51) Int. Cl.
*A46B 5/02* (2006.01)
*B43K 5/12* (2006.01)
*A45C 13/22* (2006.01)

(52) U.S. Cl. ..... 401/6; 401/192; 16/430

(58) Field of Classification Search ..... 401/6, 401/195, 192, 52; 16/430
See application file for complete search history.

(56) References Cited

U.S. PATENT DOCUMENTS 5,000,599 A 3/1991 McCall et al. ..... 401/6
6,158,910 A * 12/2000 Jolly et al. ..... 401/6
6,648,535 B1 * 11/2003 Ferrara, Jr. ..... 401/6

FOREIGN PATENT DOCUMENTS

JP 8-164692 A 6/1996
JP 8-197883 A 8/1996
JP 3024731 B2 1/2000

* cited by examiner

*Primary Examiner*—David J. Walczak
(74) *Attorney, Agent, or Firm*—Kubovcik & Kubovcik

(57) ABSTRACT

A grip using a gel substance capable of preserving its own shape is provided in a grip portion of a barrel of a writing implement. An outer coat for covering the grip portion of the barrel 1 is provided. The gel substance is located between the outer coat and the barrel, and comes in direct contact with the barrel. A centering member for positioning the outer coat coaxially with the barrel is provided between the outer coat and the barrel. The centering member is provided with an opening for allowing a space between the outer coat and the barrel to communicate with the outside of the space. The gel substance is formed by injecting a sol substance, which is a raw material, through the opening and by crosslinking the sol substance under a predetermined condition.

16 Claims, 9 Drawing Sheets

WRITING IMPLEMENT

BACKGROUND OF THE INVENTION

1. Field of the Invention

The present invention relates to a grip structure in which a grip is provided in a grip portion of a writing implement.

2. Description of the Related Art

A writing implement, which includes a coating implement such as a so-called correction pen having a similar structure to the writing implement not for the purpose of writing, is often used in daily living when writing characters and drawing pictures. It is frequently used for a long time. The ease of gripping the writing implement (grip feeling) and the degree of fatigue caused by writing depend mainly on its grip structure. Generally, the softer the grip is and the larger the contact area between fingers and the grip is, the better the grip feeling becomes. In the case, the effect of decreasing fatigue is achieved because the gripping pressure is properly dispersed. Therefore, regarding the grip structure provided in the grip portion of a barrel of the writing implement, various structures have so far been proposed.

The present applicant has proposed in Japanese Patent No. 3024731 a writing implement which comprises an outer coat made of flexible material fitted around a barrel so as to form a space between the outer coat and the outer surface of the barrel and, a liquid substance which is filled in the space between the outer coat and the outer surface of the barrel with fluidity at a normal temperature, and a grip portion constructed on the surface of the outer coat.

Certainly, by filling the liquid substance in the grip portion, the hardness of the grip portion can be decreased. Therefore, when gripping the grip, the grip portion can easily be deformed according to the degree of gripping, by which the contact area between the fingers and the grip portion increases and thus the gripping pressure is distributed. As a result, the grip feeling is improved, and fatigue caused by long use is decreased.

However, the way of gripping the writing implement and the gripping force differ between individuals. Therefore, when a user having strong gripping force grips the grip portion filled with the liquid substance having fluidity, the liquid substance flows from the portion where the user actually grips to a portion with no gripping pressure applied, and thus there seldom exists the liquid substance in the portion with gripping pressure applied. Accordingly, the fingers often feel the hardness of metal or resin material forming the barrel located inside of the liquid substance, so that the grip feeling is rather impaired.

Moreover, the outer coat is sometimes damaged by mistake and thereby a pore or crack is made, resulting that the liquid substance filled within leaks from the pore or crack to obstruct the use of the writing implement.

SUMMARY OF THE INVENTION

The present invention has been made to solve the above-described conventional technical problems, and has the first object to provide a writing implement which, without use of the liquid substance, gives no trouble of leaking of the substance contained within even if the grip is damaged, and gives effects for users of improving the grip feeling in the grip portion of the writing implement and of decreasing fatigue caused by long use.

In addition to the first object, the present invention has the second object to provide an outer coat structure which keeps the buffering substance with effects of improving the grip feeling and decreasing fatigue away from the users' hands, and which does not spoil the grip feeling.

In addition to the second object, the present invention has the third object to provide an eccentricity-preventing structure which prevents the outer coat structure and the buffering substance from being eccentric with respect to the grip portion of the writing implement.

In addition to the third object, the present invention has the fourth object to take measures so that the buffering substance can be injected into the eccentricity-preventing structure.

In addition to the second object, the present invention has the fifth object to take measures so that the buffering substance can be injected through the outer coat structure.

In addition to the second object, the present invention has the sixth object to provide the outer coat structure which cannot be eccentric with respect to the grip portion of the writing implement, and through which the buffering substance can be injected.

In addition to the second object, the present invention has the seventh object to fix the front end portion of the outer coat structure surely to the barrel portion.

In addition to the third object, the present invention has the eighth object to fix the rear end portion of the outer coat structure surely to the barrel portion.

In addition to the third object, the present invention has the ninth object to fix the front and rear end portions of the outer coat structure surely to the barrel portion.

In addition to the second, third, fourth, fifth, sixth, seventh, eighth, or ninth object, the present invention has the tenth object to make the content of the writing implement easily seen from outside.

In addition to the second, third, fourth, fifth, sixth, seventh, eighth, or ninth object, the present invention has the eleventh object to effectively prevent the outer coat from being turned up from the front end portion.

In addition to the eighth or ninth object, the present invention has the twelfth object to effectively prevent the outer coat from being turned up from the rear end portion.

The following is a detailed description of methods for achieving the above objects.

The gist of the present invention is to provide a grip structure in which a grip provided in a grip portion of a barrel of a writing implement is made of a gel substance capable of preserving its own shape.

(1) First Invention

To achieve the first object, the first invention of the present invention provides a writing implement having a grip structure in which a grip is provided in a grip portion of a barrel, wherein the grip of the grip structure is made of gel substance capable of preserving its own shape.

The "writing implement" in the present invention means an implement for writing by drawn lines, such as a ballpoint pen, a mechanical pencil, a brush-tip pen, a fountain pen, etc. Moreover, the writing implement in the present invention includes a "coating implement" for applying a liquid substance not for the purpose of writing, which has a grip portion like that of the writing implement. Concretely, the coating implement includes a so-called correction pen for applying correction fluid to correct miswritten characters. Moreover, a vessel for some kind of liquid cosmetics falls is included by the coating implement.

The "gel substance" used in the present invention means a gel substance which has a three-dimensional network structure while containing liquid in it by chemical or physical crosslinking function between polymers, and which itself is formed so as to preserve its own shape.

By providing such a gel substance capable of preserving its own shape in the grip portion of the writing implement, molding can be performed with low hardness. Moreover, when the grip is gripped, the gel substance deforms easily. Therefore, the contact area between the fingers and the grip portion increases and hence the gripping pressure is dispersed properly, so that effects of improving the grip feeling and decreasing fatigue caused by long use can be provided.

Regarding the grip structure of the writing implement, if the grip using the gel substance capable of preserving its own shape is provided in the grip portion of the writing implement, the grip portion may be formed only by the gel substance capable of preserving its own shape, or a structure covering the gel substance may be provided in addition to the gel substance.

Moreover, comparing with the case where a liquid substance having fluidity is used in the grip portion of the writing implement, since the gel substance capable of preserving its own shape has a property such that it deforms but does not flow when being gripped, the gripping fingers can always have comfortable feel of the gel substance. Therefore, even if there is a difference in gripping force between individuals, the effects of comfortable grip feeling and decreasing fatigue caused by long use can be obtained, and the effects can be provided to the user. Further, since the gel substance is capable of preserving its own shape, even if the outer coat is damaged during the use, the gel substance does not leak. Furthermore, the gel substance can be formed in an exposed state without providing the outer coat itself.

In the writing implement provided with the above-described grip structure in the grip portion, because no liquid substance is used, there is no trouble of leaking of the substance in the grip portion even if the grip is damaged. Moreover, the effects of improving the grip feeling in the grip portion of the writing implement and decreasing fatigue caused by long use can be provided to the user.

(2) Second Invention

To achieve the second object, the second invention of the present invention provides the writing implement comprising, in addition to the characteristic of the first invention, an outer coat covering the grip portion of the barrel, wherein the gel substance is located between the outer coat and the barrel and comes in direct contact with the barrel.

The "outer coat" means a member covering the grip portion of the barrel. In a space between the outer coat and the barrel, the gel substance is located. Specifically, nothing is interposed between the gel substance and the barrel, and these elements come in direct contact with each other.

For example, if the outer coat which has a bag-shaped structure in which the gel substance is filled is fitted on the barrel, (i) an inner part of the bag, (ii) the gel substance, and (iii) an outer part of the bag are arranged in this order between the barrel and the fingers. Therefore, the buffering action of the gel substance is impaired by the two parts (i) and (iii) of the bag.

On the other hand, in the case of the second invention, (i) the gel substance and (ii) the outer coat are arranged in this order between the barrel and the fingers. Therefore, the buffering action of the gel substance is less impaired than in the case where the outer coat has the bag-shaped structure.

Specifically, in the writing implement provided with the above-described grip structure in the grip portion, the outer coat prevents the gel substance, which achieves effects of improving the grip feeling and decreasing fatigue, from being directly touched by the user's hand. Moreover, such an outer coat structure can prevent the grip feeling from being impaired.

(3) Third Invention

To achieve the third object, the third invention of the present invention provides the writing implement comprising, in addition to the characteristic of the second invention, a centering member for positioning the outer coat coaxially with the barrel between the outer coat and the barrel.

The term "centering" means aligning of the axis of the outer coat with that of the barrel. If the outer coat is eccentric with respect to the barrel, the gel substance located between the outer coat and the barrel is distributed unevenly. In this case, the contact condition between the gel substance and the fingers changes according to an angle gripping the grip portion during use, so that the effect of distributing the gripping pressure of the gel substance is not constant for every use. Therefore, in order to make the effect of distributing the gripping pressure of the gel substance constant, it is necessary to position the outer coat coaxially with the barrel.

The "centering member" means a member provided between the outer coat and the barrel to position the outer coat coaxially with the barrel.

The centering member may be formed either (A) integrally with the outer coat, (B) integrally with the barrel, (C) integrally with both of the outer coat and the barrel, or (D) separately from the outer coat and the barrel.

Specifically, in the above case (A), the centering member can be a plurality of protrusions projecting inward at an end of the outer coat, the protrusions having the same height. In the above case (B), the centering member can-be a plurality of protrusions projecting outward on the outer surface of the barrel corresponding to an end of the outer coat, the protrusions having the same height. In the above case (C), a plurality of protrusions having the same height, which are the same as those in the cases (A) and (B), can be provided on both of the outer coat and the barrel as the centering member. Moreover, in the above case (D), a ring-shaped member having a uniform thickness in the circumferential direction may be inserted between the outer coat and the barrel as the centering member.

In the case (A), (B) or (C), the number and the arrangement of the protrusions are not subject to any special restriction. However, from the viewpoint of prevention of eccentricity of the outer coat with respect to the barrel, the number of protrusions is preferably three or more. Moreover, it is also preferable that the protrusions be arranged at equal intervals in the circumferential direction.

In the writing implement provided with the above-described grip structure in the grip portion, the outer coat and the gel substance as a buffering substance can be so formed that they are not eccentric with respect to the grip portion of the writing implement. Moreover, the effect of distributing the gripping pressure of the gel substance can be made constant regardless of the gripping angle of grip portion.

(4) Fourth Invention

To achieve the fourth object, the fourth invention of the present invention provides the writing implement wherein, in addition to the characteristic of the third invention, the centering member is provided with an opening which allows a space between the outer coat and the barrel to communicate with the outside of the space.

The "opening" means a structure for injecting the gel substance into the space between the outer coat and the barrel.

For example, in the above case (3) (A), (B) or (C), gaps between the protrusions can be used as the opening. Moreover, in the above case (3) (D), holes provided in the ring-shaped member can be used as the opening.

In the writing implement provided with the above-described grip structure in the grip portion, measures can be taken to inject the gel substance in the space between the outer coat and the barrel while the centering member is provided.

It is preferable that the gel substance be formed by injecting a sol substance, which is a raw material, through the opening and by crosslinking the sol substance under a predetermined condition.

The term "crosslinking" means to cause any chemical force to act between molecules of the sol substance to decrease its fluidity. The "predetermined condition" differs depending on the kind of the sol substance. For example, when the crosslinking of the sol substance is accelerated by heating to a predetermined temperature, the heating to such a temperature constitutes the "predetermined condition." Moreover, when the crosslinking is caused to proceed by leaving the sol substance as it is for a predetermined period of time or more without any other means, the leaving for such a period of time constitutes the "predetermined condition."

(5) Fifth Invention

To achieve the fifth object, the fifth invention of the present invention provides the writing implement wherein, in addition to the characteristic of the second invention, the outer coat is provided with an opening which allows a space between the outer coat and the barrel to communicate with the outside of the space.

The "opening" means a structure for injecting the gel substance into the space between the outer coat and the barrel. This opening is provided in the outer coat itself.

For example, both ends of the outer coat are brought into close contact with the barrel, and a hole is formed near an end thereof, whereby this hole can be used as the opening. Thus, the gel substance can be injected in the space between the outer coat and the barrel through this opening.

Moreover, though the both ends of the outer coat are brought into close contact with the barrel, the opening may not be provided in advance in the outer coat. In this case, an injection needle or the like is pricked into the outer coat, whereby the gel substance can be injected through the injection needle or the like. In this case, the hole produced by the prick of the injection needle or the like can be regarded as the opening.

In the writing implement provided with the above-described grip structure in the grip portion, measures can be taken to inject the buffering substance through the outer coat.

It is preferable that the gel substance be formed by injecting a sol substance, which is a raw material, through the opening and by crosslinking the sol substance under a predetermined condition.

The meanings of the terms "crosslinking" and "predetermined condition" are as described in section (4).

(6) Sixth Invention

To achieve the sixth object, the sixth invention of the present invention provides the writing implement wherein, in addition to the characteristic of the second invention, an end of the outer coat is in contact with the whole circumference of the barrel, and another end of the outer coat is in contact with the barrel at three points.

For example, on one of the ends of the outer coat, protrusions are provided at three locations at the outer periphery of the barrel (preferably arranged at equal intervals in the circumferential direction), by which the barrel is brought into contact with the end of the outer coat. In the writing implement provided with the above-described grip structure in the grip portion, by these protrusions, the outer coat can be so formed that the outer coat is not eccentric with respect to the grip portion of the writing implement. Moreover, the gel substance can be injected through gaps between the protrusions.

It is preferable that the gel substance be formed by injecting a sol substance, which is a raw material, through the gap between the outer coat and the barrel and by crosslinking the sol substance under a predetermined condition.

The meanings of the terms "crosslinking" and "predetermined condition" are as described in section (4).

(7) Seventh Invention

To achieve the seventh object, the seventh invention of the present invention provides the writing implement wherein, in addition to the characteristic of the second invention, a collar portion annularly projecting towards outside is provided near the front end of the grip portion of the barrel; an annular convex portion annularly projecting towards inside is provided on the internal surface near the front end of the outer coat; and the annular convex portion is in close contact with the collar portion.

The annular convex portion can be brought into close contact with the collar portion in various manners. For example, it is possible that a flat surface is formed on each of the front surface of the annular convex portion and the rear surface of the collar portion, and these surfaces are brought into close contact with each other. Moreover, it is possible that an annular groove is provided in the outer edge portion of the collar portion, and the annular convex portion is so formed as to be inserted into this groove, by which the outer coat and the barrel can be fixed surely. Further, it is possible that two rows of front and rear annular convex portions are provided, and the collar portion is inserted into a gap between the two annular convex portions.

In the writing implement provided with the above-described grip structure in the grip portion, the front end portion of the outer coat is surely fixed to the barrel. Thereby, the front end of the outer coat can be prevented from shifting with respect to the barrel when the grip portion is gripped.

(8) Eighth Invention

To achieve the eighth object, the eighth invention of the present invention provides the writing implement wherein, in addition to the characteristic of the third invention, the centering member is so provided as to project outward near the rear end of the grip portion of the barrel, and the rear end of the outer coat is in close contact with the centering member.

The rear end of the outer coat can be brought into close contact with the centering member in various manners. For example, it is possible that the rear surface of rear end of the outer coat and the front surface of the centering member each are formed into a flat surface, and these surfaces are brought into close contact with each other. Moreover, an annular groove is provided in the outer edge portion of the centering member, and a convex portion is provided on the internal surface of rear end of the outer coat so as to be inserted into the groove, by which the outer coat and the barrel can be fixed surely. Further, it is possible that two rows of front and rear convex portions are provided on the internal surface of rear end of the outer coat, and the centering member is inserted into a gap between the two convex portions.

In the writing implement provided with the above-described grip structure in the grip portion, the rear end portion of the outer coat is surely fixed to the barrel. Thereby, the rear end of the outer coat can be prevented from shifting with respect to the barrel when the grip portion is gripped.

(9) Ninth Invention

To achieve the ninth object, the ninth invention of the present invention provides the writing implement wherein, in addition to the characteristic of the third invention, a collar portion annularly projecting towards outside is provided near the front end of the grip portion of the barrel; the centering member is so provided as to project outward near the rear end of the grip portion of the barrel; an annular convex portion annularly projecting towards inside is provided on the internal surface near the front end of the outer coat; the annular convex portion is in close contact with the collar portion; and the rear end of the outer coat is in close contact with the centering member.

The annular convex portion is brought into close contact with the collar portion in the same manner as described in the above case (7), and the rear end of the outer coat is brought into close contact with the centering member in the same manner as described in the above case (8).

In the writing implement provided with the above-described grip structure in the grip portion, the front and rear end portions of the outer coat are surely fixed to the barrel. Thereby, the front and rear ends of the outer coat can be prevented from shifting with respect to the barrel when the grip portion is gripped.

(10) Tenth Invention

To achieve the tenth object, the tenth invention of the present invention provides the writing implement wherein, in addition to the characteristic of the second, third, fourth, fifth, sixth, seventh, eighth, or ninth invention, the barrel, the outer coat, and the gel substance are transparent.

In the writing implement provided with the above-described grip structure in the grip portion, the content of the writing implement (for example, in the case of writing implement, the color and remaining quantity of ink; and in the case of coating implement, the remaining quantity of coating fluid) can be seen easily from outside.

(11) Eleventh Invention

To achieve the eleventh object, the eleventh invention of the present invention provides the writing implement wherein, in addition to the characteristic of the second invention, a writing point and a ferrule are provided at the front end of the barrel; the front end portion of the outer coat is in contact with the ferrule; and the outside diameter of the outer coat in the contact portion is smaller than the outside diameter of the ferrule in the contact portion.

In the contact portion between the outer coat and the ferrule, the outside diameter of the outer coat is equal to or smaller than the outside diameter of the ferrule. Therefore, in the contact portion between the outer coat and the ferrule, the front end surface of the outer coat does not project from the outer periphery of the ferrule, so that the front end surface of the outer coat is prevented from being caught by something and being turned up.

Thereby, the outer coat can be effectively prevented from being turned up from the front end portion.

In the eleventh invention as well, if the barrel, the outer coat, and the gel substance are transparent, the content of the writing implement (for example, in the case of writing implement, the color and remaining quantity of ink; and in the case of coating implement, the remaining quantity of coating fluid) can be seen easily from outside.

(12) Twelfth Invention

To achieve the twelfth object, the twelfth invention of the present invention provides the writing implement wherein, in addition to the characteristic of the eighth or ninth invention, a writing point is provided at the front end of the barrel; the barrel is formed by a front barrel and a rear barrel; the centering member is so provided as to project outward near the rear end of the grip portion of the front barrel; the rear end of the outer coat is in close contact with the centering member; and a contact portion between the outer coat and the centering member is covered by the rear barrel when the front barrel is engaged with the rear barrel.

In the twelfth invention, the barrel is formed by two parts of front barrel and rear barrel, which are engaged with each other, for example, by screw engagement. In this engagement, the rear end of the outer coat is covered by the front end portion of the rear barrel, so that the rear end of the outer coat is not exposed outside. Therefore, the rear end of the outer coat is not caught by something and is not turned up.

Thereby, the outer coat can be effectively prevented from being turned up from the rear end portion.

In the twelfth invention as well, if the barrel, the outer coat, and the gel substance are transparent, the content of the writing implement (for example, in the case of writing implement, the color and remaining quantity of ink; and in the case of coating implement, the remaining quantity of coating fluid) can be seen easily from outside.

DETAILED DESCRIPTION OF THE PREFERRED EMBODIMENTS

Embodiments of the present invention will now be described in detail with reference to the accompanying drawings.

(1) First Embodiment

Figure 1:
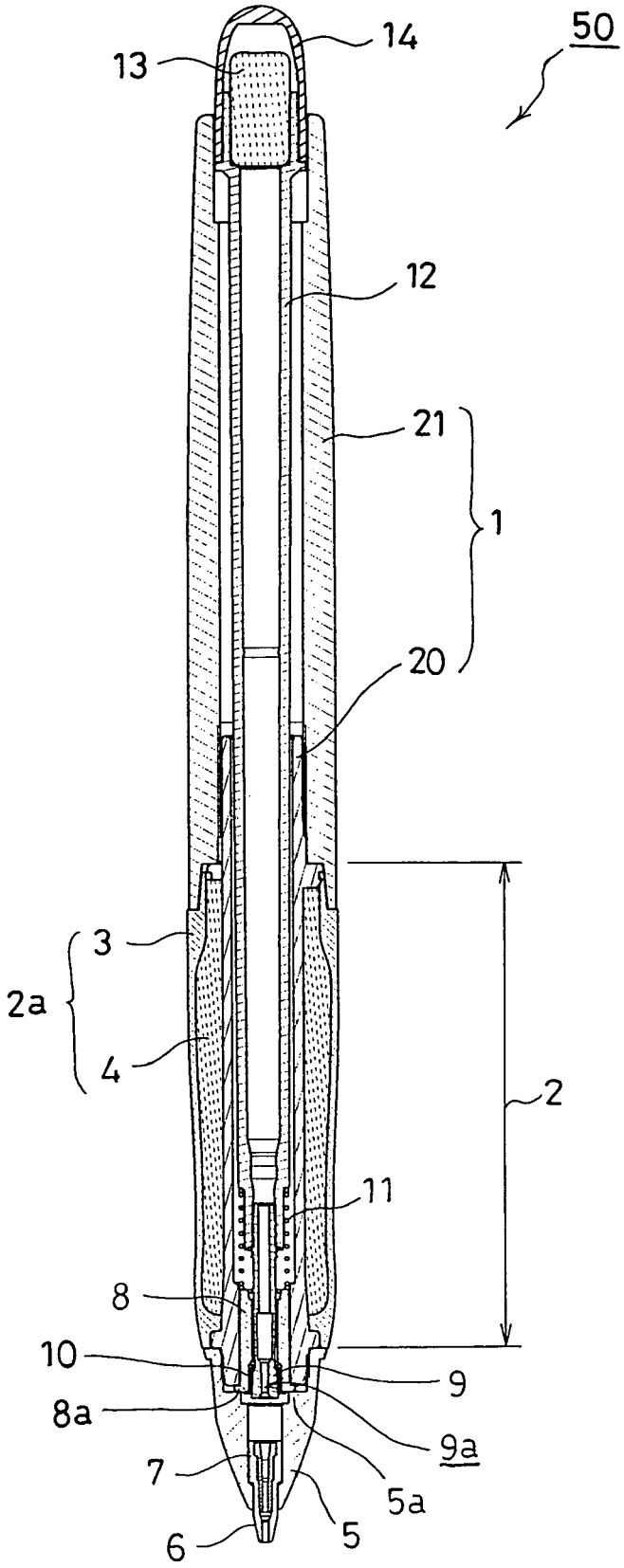
FIG. 1 is a longitudinal sectional view of a mechanical pencil used as a writing implement in accordance with the first embodiment of the present invention.
Figure 2:
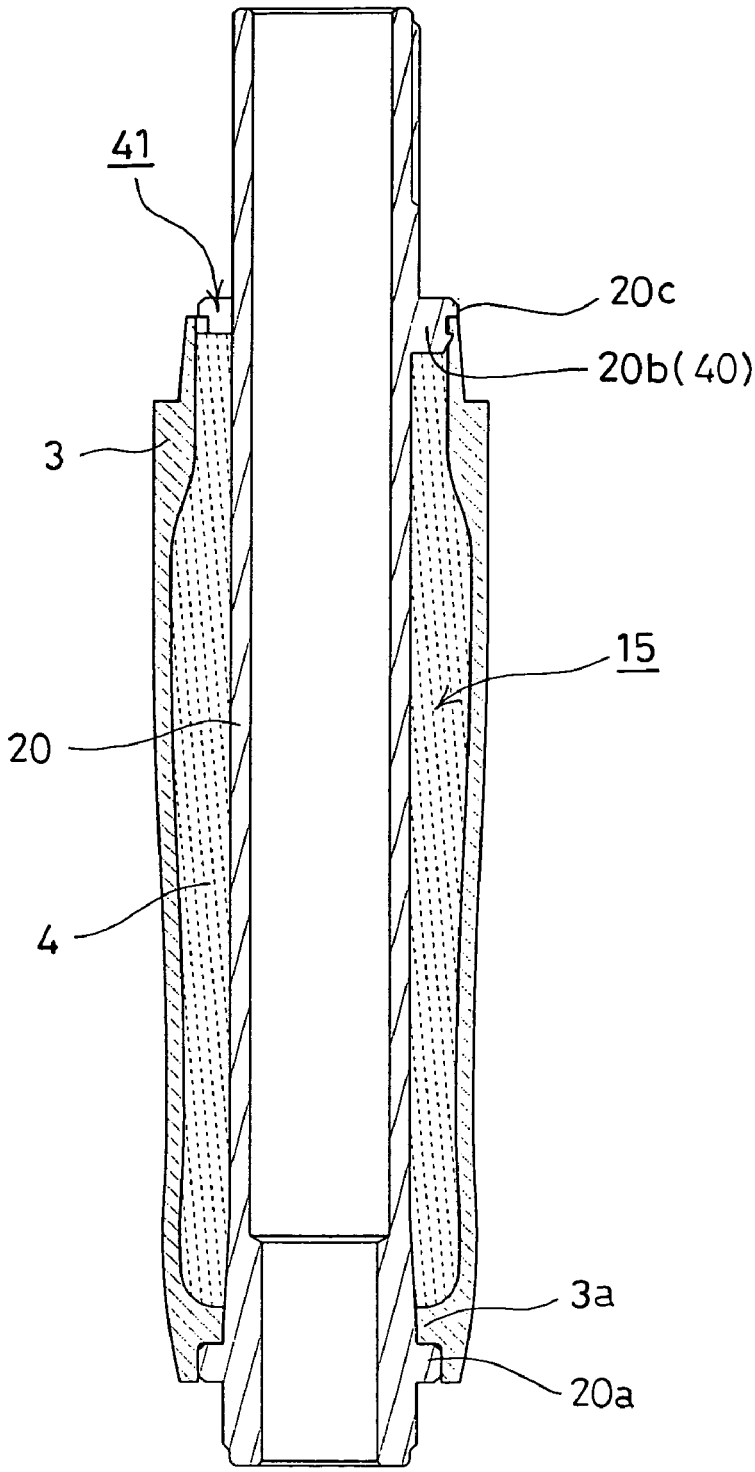
FIG. 2 is a longitudinal sectional view of a front barrel portion of a mechanical pencil used as a writing implement in accordance with the first embodiment of the present invention.

FIG. 1 is a longitudinal sectional view of a mechanical pencil used as a writing implement 50 in accordance with a first embodiment of the present invention. FIG. 2 is a longitudinal sectional view of a front barrel portion of the mechanical pencil used as the writing implement 50 in accordance with the first embodiment of the present invention.

The writing implement 50 is not limited to a mechanical pencil, and a grip 2*a* can be used for a ballpoint pen, a brush-tip pen, a fountain pen, etc.

In this specification, front means the direction toward the pen point, and rear means the direction opposite to the pen point.

In this embodiment, a grip portion 2 of the mechanical pencil used as the writing implement 50 has a grip structure as described below.

A barrel 1 is formed by two parts: a front barrel 20 arranged on the front end side in the axial direction and a rear barrel 21 arranged on the rear end side. The front barrel 20 and the rear barrel 21 are fixed to each other by screw engagement, by which the barrel 1 is formed.

At the outer periphery of the front barrel 20 is provided an outer coat 3. At the front part of the outer coat 3, an annular convex portion 3*a* on the internal surface thereof is in contact with a collar portion 20*a* of the front barrel 20. The rear part of the outer coat 3 is fixed to the barrel 1 by being held between the outer peripheral surface of a convex portion 20*b* at the rear of the front barrel 20 and the internal wall surface of the rear barrel 21 when the front barrel 20 is screwed to be engaged with the rear barrel 21. Specifically, the rear end portion of the outer coat 3 is covered by the front end portion of the rear barrel 21.

Further, a ferrule 5 is screwed to be engaged in front of the front barrel 20. The rear end of the ferrule 5 is in contact with the front end of the outer coat 3. In this contact portion, the outside diameter of the outer coat 3 is equal to the outside diameter of the ferrule 5, and the front end of the outer coat 3 does not project from the ferrule 5. In the ferrule 5, a front end pipe 6, which is a writing point, is provided slidably in the axial direction so as to be capable of coming in and out. In the front end pipe 6, a holding chuck 7 formed of an elastic material such as rubber or elastomer is fixed to prevent a writing lead (not shown) from moving rearward together with a chuck 9.

In the front part of the front barrel 20 is inserted a joint 8. A joint collar portion 8*a* in the front end of the joint 8 is fixed by being held between a step portion 5*a* in the rear end internal portion of the ferrule 5 and the front end portion of the front barrel 20. In a through hole in the joint 8, there is slidably provided, in a front portion thereof, the chuck 9 having a slit portion 9*a* formed into two pieces or three pieces so as to be expandable and contractable. At the front part of the slit portion 9*a*, a tightening member 10 for contracting the slit portion is so provided as to be housed in the joint 8.

The rear part of the chuck 9 is fitted in a lead case 12 for storing a writing lead. Between the joint 8 and the lead case 12 is provided a spring 11. At the rear part of the lead case 12, an eraser 13 and a knock cover 14 are provided detachably so that the eraser 13 is covered by the knock cover 14. The eraser 13 can be used by being exposed by the removal of the knock cover 14.

Figure 3:
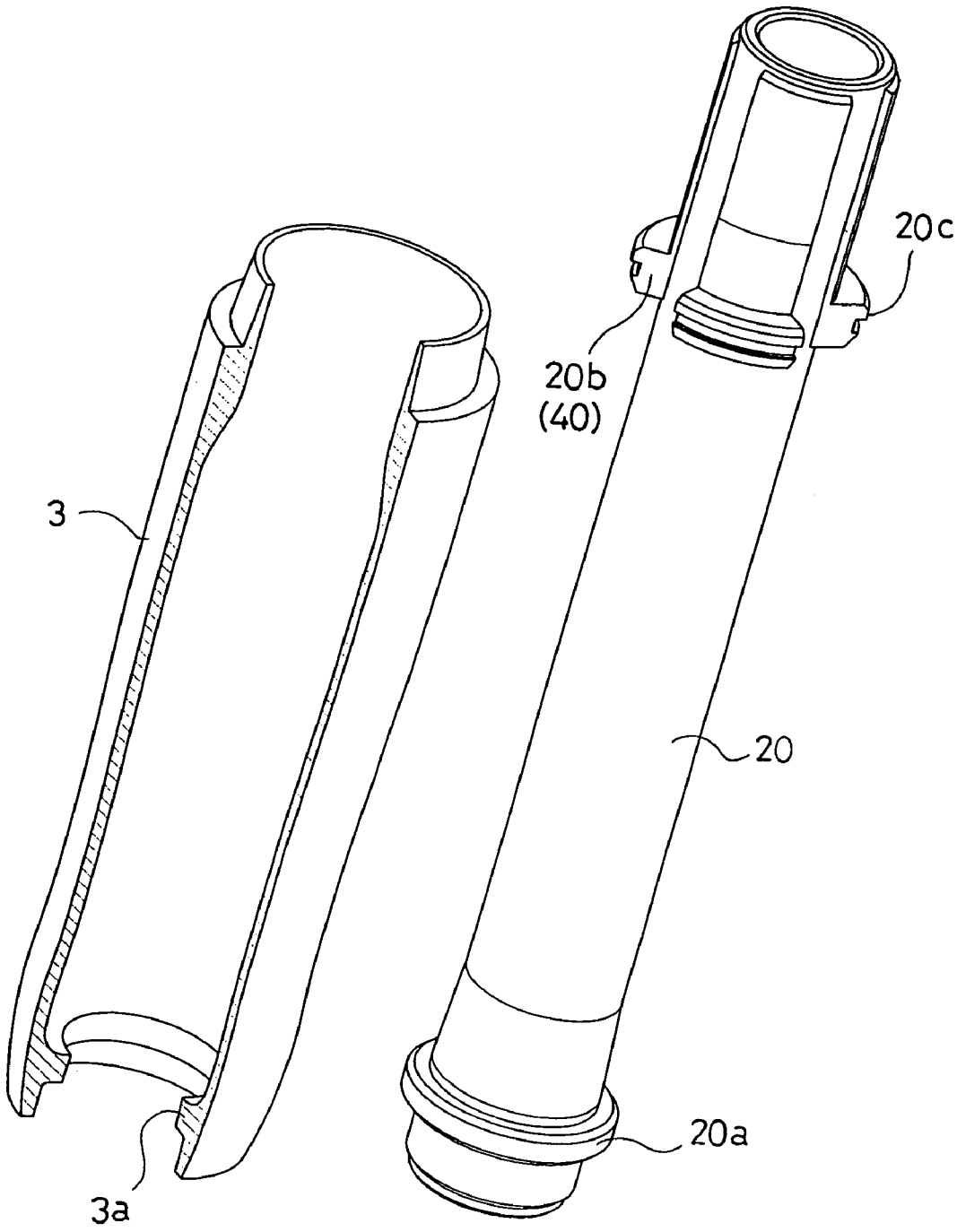
FIG. 3 is a view showing a procedure for forming the gel substance in a grip, showing a state before a front barrel is assembled to an outer coat.
Figure 4:
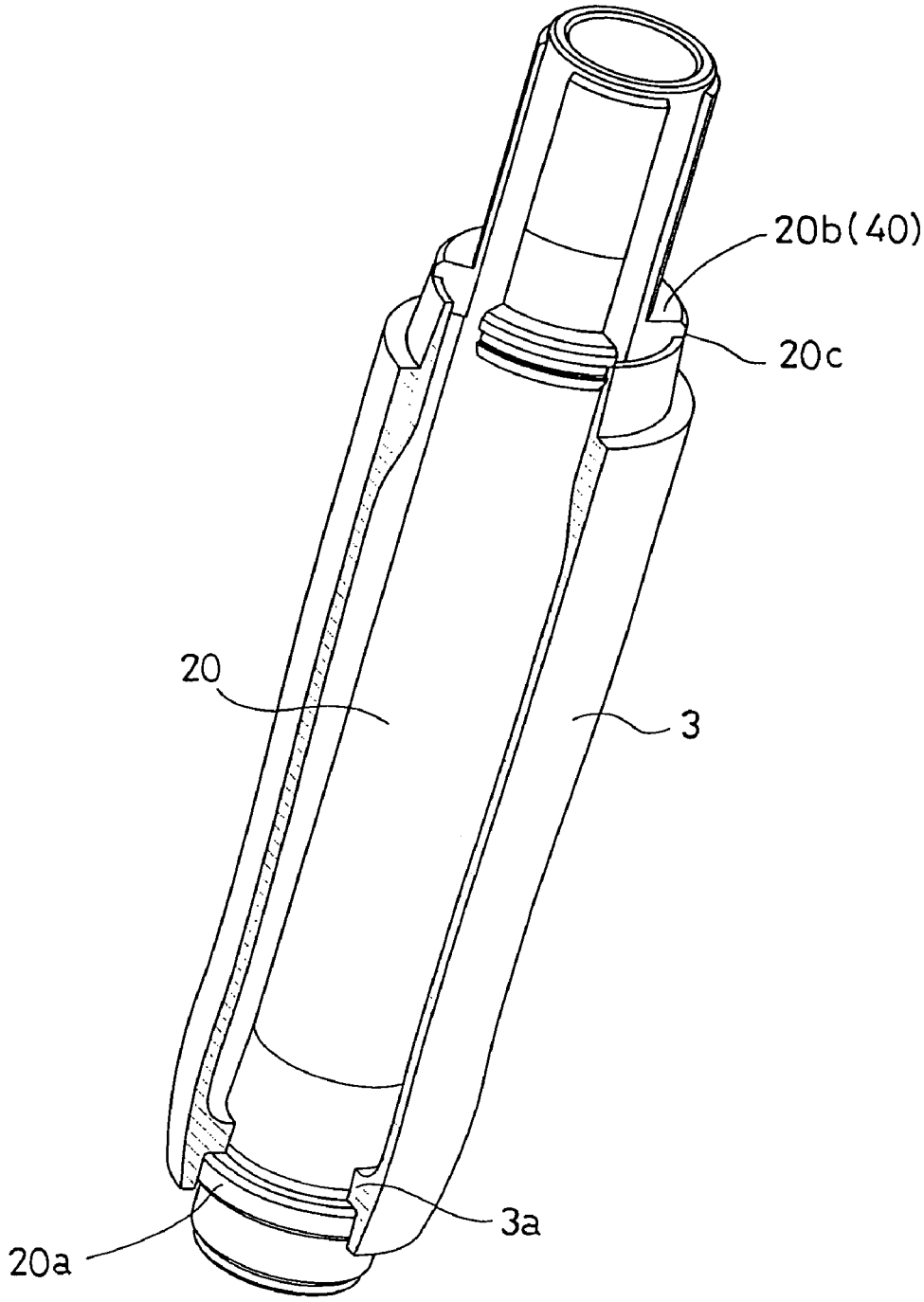
FIG. 4 is a view showing a procedure for forming the gel substance in a grip, showing a state after a front barrel has been assembled to an outer coat.

The front barrel 20 has the collar portion 20*a* at the front part, and has three convex portions 20*b* serving as a centering member 40, which are arranged at equal intervals in the circumferential direction, at the rear part thereof (see FIGS. 3 and 4). The collar portion 20*a* at the front part of the front barrel 20 is in contact with the annular convex portion 3*a* formed on the inner peripheral surface of the front portion of the outer coat 3. Further, in an engagement portion 20*c* provided on the outer peripheral surface of the convex portion 20*b* at the rear part of the front barrel, the front barrel 20 and the outer coat 3 are fixed to each other by bringing the rear end portion of the outer coat 3 into contact with the engagement portion 20*c*. In a space 15 between the front barrel 20 and the outer coat 3, which is formed by fixing the outer coat 3 to the front barrel 20, a gel substance 4 capable of preserving its own shape is incorporated.

The outer coat 3 may be formed of any elastic material. Any elastic material such as silicone rubber, urethane rubber, and ethylene propylene rubber can be used, and silicone rubber is especially preferable.

Moreover, the gel material 4 may be formed of any material that can hold its own shape. Any gel material such as silicone gel, acrylic gel, and urethane gel can be used, and silicone gel is especially preferable. As an example of commercially available product, "αGEL" (registered trademark) manufactured by GELTEC Co., Ltd. is cited.

In this embodiment, the outer peripheral surface of the gel substance 4 is covered by the outer coat 3, and the grip 2*a* is formed by the outer coat 3 and the gel substance 4. If the grip 2*a* is formed only by the gel substance 4, the effect of the present invention is achieved without the outer coat 3. In this case, however, since the gel substance 4 has a very low hardness and the surface thereof is somewhat sticky, there arises a problem in that dust or the like adheres to the surface and thus the surface is easily contaminated, and the surface is liable to adhere to the fingers that grip the mechanical pencil. Therefore, it is desirable to provide the outer coat 3 in actual use because the provision of the outer coat 3 solves the above problem. As another method for preventing the stickiness of the gel substance, surface treatment methods such as a method in which the surface of the gel substance 4 is reformed by ultraviolet irradiation or a method in which a substance different from the gel substance 4 is deposited or applied can be cited.

When the outer coat 3 is provided, it is preferable that the thickness of the gel substance 4 be set so as to be larger than the thickness of the outer coat 3. As a concrete numerical value of the thickness of the gel substance 4 and the outer coat 3, the thickness of the outer coat 3 is preferably set so as to be not smaller than 10 μm and not larger than 2.0 mm in the substantial center of the grip 2*a*, and the thickness of the gel substance 4 is preferably set so as to be not smaller than 1.0 mm and not larger than 3.5 mm. In this embodiment, the thickness of the outer coat 3 is set at 0.4 mm, and the thickness of the gel substance 4 is set at 2.5 mm.

If the thickness of the outer coat 3 is smaller than 10 μm, the grip feeling peculiar to the gel substance 4 can be obtained easily, but the thickness of the outer coat 3 becomes extremely thin, so that it is difficult to mold the outer coat 3. Even if the outer coat 3 can be molded, it is vulnerable to an external force. Therefore, there arises a problem in that a flaw is easily developed, which mars the appearance.

If the thickness of the gel substance 4 exceeds 3.5 mm, the diameter of grip is increased, so that the grip feeling inversely becomes bad.

If the thickness of the gel substance 4 is smaller than the thickness of the outer coat 3, if the thickness of the outer coat 3 exceeds 2.0 mm, or if the thickness of the gel substance 4 is smaller than 1.0 mm, the grip feeling peculiar to the gel substance 4 cannot be fully achieved.

The hardness of the gel substance 4 is preferably not less than 20 and not more than 200 by penetration degree (JIS K2207).

If the penetration degree is less than 20, deformation occurring when the grip 2*a* is gripped is insufficient because of too high hardness, so that the contact area between the fingers and the grip portion cannot be provided sufficiently. As a result, the gripping pressure is not fully distributed, so that the effects of the present invention cannot be achieved sufficiently.

If the penetration degree is more than 200, the deformation amount of the gel substance 4 when the grip 2*a* is gripped increases because of too low hardness. Thereby, a hard feel of the barrel 1 formed of a metallic material or resin material is somewhat given to the fingers gripping the grip 2*a*. Therefore, the grip feeling rather becomes bad, and an effect of decreasing fatigue caused by long use may be reduced.

It is preferable that the gel substance 4 be bonded or adhered to the front barrel 20 or the front barrel 20 and the outer coat 3 by the grip structure. At the time of writing, a writing pressure applied in the axial direction of the barrel 1 is produced in addition to the gripping pressure applied in the radial direction of the barrel 1. Therefore, especially when the gel substance 4 is provided independently in the grip portion 2 of the barrel 1, the gel substance 4 is liable to shift in the axial direction. To prevent this shift, the gel substance 4 is bonded or adhered to the front barrel 20 or the front barrel 20 and the outer coat 3, whereby the axial shift of the gel substance 4 at the time of writing can be prevented.

The gel substance 4 can be bonded or adhered to the front barrel 20 or the outer coat 3 as it is depending on the material thereof. However, the gel substance 4 is formed in a state in which the front barrel 20 or the outer coat 3 is coated with an adhesive or a sticky material in advance, by which the shift of the gel substance 4 occurring when a writing pressure is applied to the grip 2*a* can be prevented regardless of the method for forming the grip 2*a*.

Figure 5:
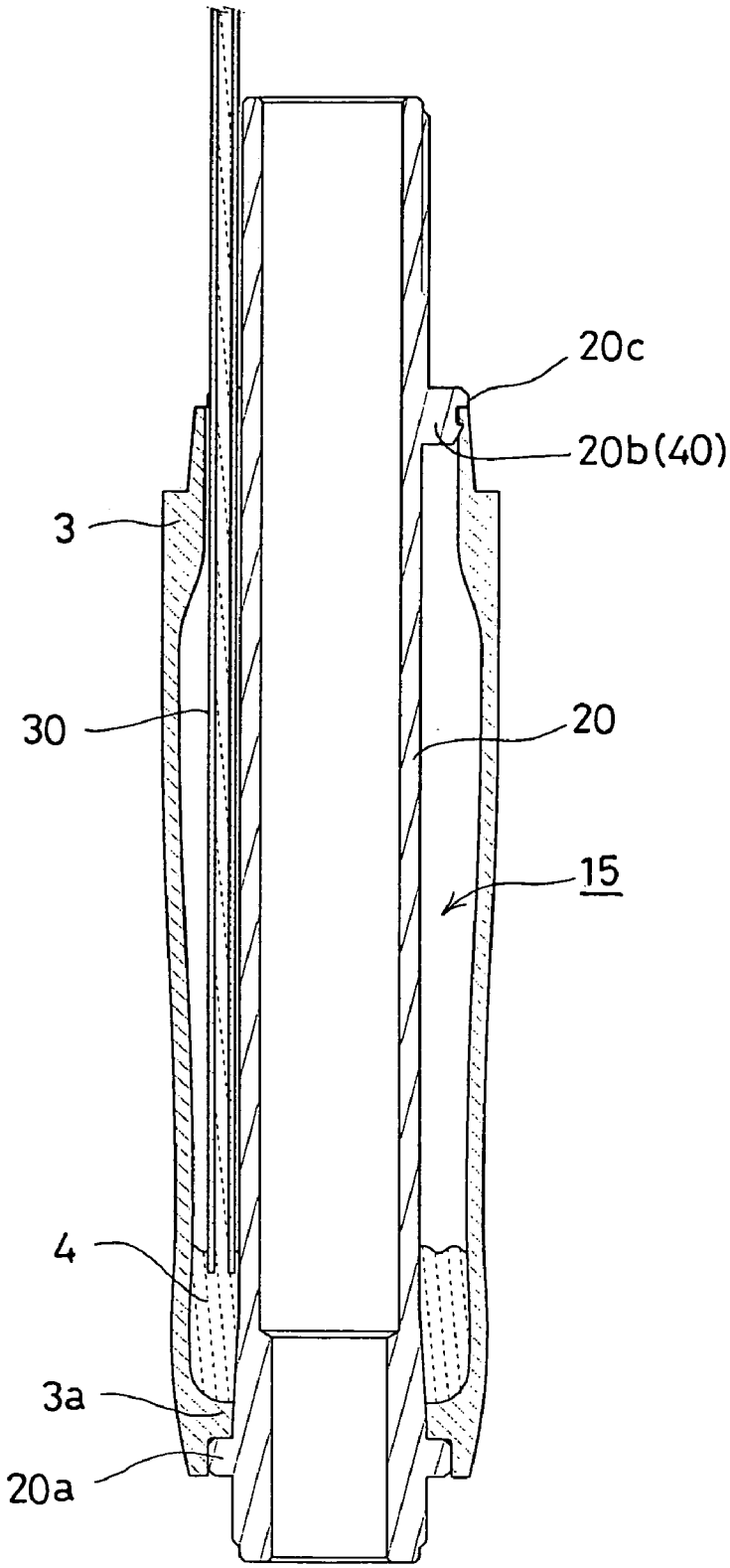
FIG. 5 is a view showing a procedure for forming the gel substance in a grip, showing a process in which the gel substance is injected into a grip.

FIGS. 3 to 5 are process views showing a procedure for forming the grip 2*a* in accordance with the first embodiment of the present invention.

FIG. 3 shows a state before the front barrel 20 is assembled to the outer coat 3. The outer coat 3 is shown with a portion cut off to facilitate understanding the inside structure.

FIG. 4 shows a state after the front barrel 20 has been assembled to the outer coat 3.

In the method for assembling the front barrel portion in this embodiment, the outer coat 3 has only to be inserted from the front or rear of the front barrel 20 until the annular convex portion 3*a* on the internal surface of the outer coat 3 comes into contact with the collar portion 20*a* of the front barrel 20. When the outer coat 3 is inserted on the front barrel 20 to the end, the rear end portion of the outer coat 3 is assembled to the engagement portion 20*c* provided on the outer peripheral surface of the convex portion 20*b* at the rear part of the front barrel 20.

FIG. 5 is a view showing a step in which the gel substance 4 is injected into the space 15 formed between the front barrel 20 and the outer coat 3.

An injection nozzle 30 is inserted through a gap between the three convex portions 20*b* arranged at equal intervals on the circumference at the rear part of the front barrel 20, by which the gel substance 4 is injected through the injection nozzle 30. The number of the injection nozzles 30 may be one or plural. The provision of plural injection nozzles advantageously shortens the injection time. The gel substance 4 still exhibits fluidity until it is injected, and after being injected, it is cured by being allowed to stand at room temperature or by being heated, by which its own shape can be held. A typical example of the gel substance 4 is as follows:

$$RR^1{}_2SiO—(R^2{}_2SiO)_nSiR^1{}_2R \qquad \text{(Formula 1)}$$

where R is an alkenyl group, $R^1$ is primary hydrocarbon group having no aliphatic unsaturated bond, $R^2$ is primary aliphatic hydrocarbon group (at least 50 mol % of $R^2$ is methyl group. When having an alkenyl group, the content thereof is not more than 10 mol %), and n is a numeral such that the viscosity of this component at 25° C. is 100 to 10,000 cSt.

The gel substance expressed by Formula 1 comprises diorganopolysiloxane (component A) and organohydrogenpolysiloxane (component B) whose viscosity at 25° C. is 5000 cSt or lower, having at least one hydrogen atom directly connected to Si atom in one molecule, and is an addition type silicone copolymer obtained by curing a mixture controlled so that the ratio (molecular ratio) of the total quantity of alkenyl group contained in diorganopolysiloxane (component A) to the total quantity of hydrogen atoms directly connected to Si atom in organohydrogenpolysiloxane (component B) is 0.1 to 2.0.

The curing reaction of gel substance of Formula 1 is carried out by using a catalyst. As this catalyst, a platinum-based catalyst is preferable. As examples thereof, finely ground element platinum, chloroplatinic acid, platinum oxide, and a complex salt of platinum and olefin, complex salts of platinum alkoxide and chloroplatinic acid and vinyl siloxane, etc. can be cited.

After component A, component B, and the catalyst, which are mentioned above, have been mixed with each other, the gel substance 4 having fluidity is injected into the space 15 formed between the front barrel 20 and the outer coat 3 through the injection nozzle 30. After the space 15 has been filled with the gel substance 4, the gel substance 4 is cured by being allowed to stand at room temperature or by being heated, by which the gel substance 4 having fluidity when being injected is made in a state in which its own shape can be held.

In the first embodiment of the present invention, the gel substance 4 is injected by inserting the injection nozzle 30 into the space 15 formed in the grip portion 2 of the barrel 1 through the gap, which is formed as an opening 41, between the three convex portions 20*b* arranged at equal intervals on the circumference at the rear part of the front barrel 20. However, the injection method is not limited to the above-described method. For example, a method may be used in which the front and rear end portions fixing the front barrel 20 and the outer coat 3 to each other are closed, a hole communicating with the space 15 formed by the front barrel 20 and the outer coat 3 is formed in the side surface of the front barrel 20, and the injection nozzle 30 is inserted from the communicating hole through a through hole in the front barrel to inject the gel substance 4 having fluidity via the injection nozzle 30; thereafter, the gel substance 4 may be cured.

Moreover, no problem is presented by the use of a method in which the gel substance 4 having been cured in advance so that a state in which its own shape can be held is established is formed into a sheet shape, and after the sheet-shape gel substance 4 is cut into proper dimensions, it is wound around the outer periphery of the front barrel 20 coated with an adhesive, or a method in which the gel substance 4 capable of being injection molded is used, and after the front barrel 20 and the gel substance 4 are molded successively by two-color molding, the outer coat 3 is provided. By the use of these methods as well, the effects of the present invention can be achieved by using the gel substance capable of preserving its own shape in the grip portion 2 of the writing implement 50.

(2) Second Embodiment

Figure 6:
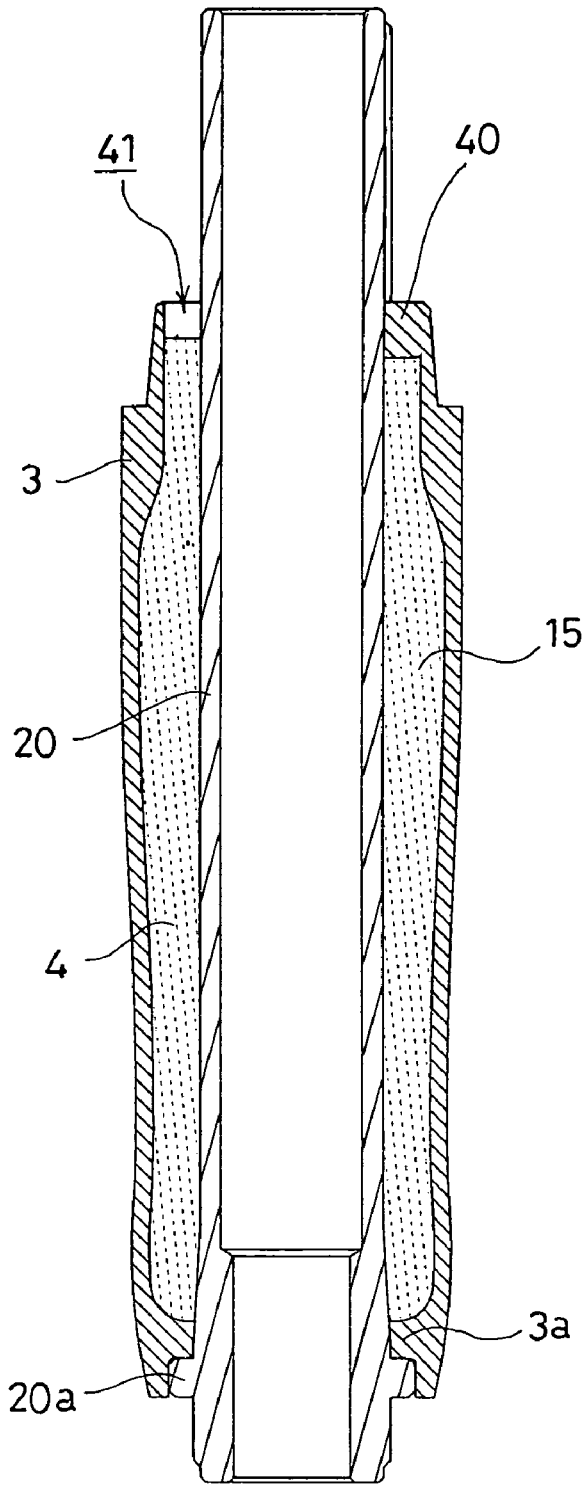
FIG. 6 is a longitudinal sectional view of a front barrel portion of a mechanical pencil used as a writing implement in accordance with the second embodiment of the present invention.
Figure 7:
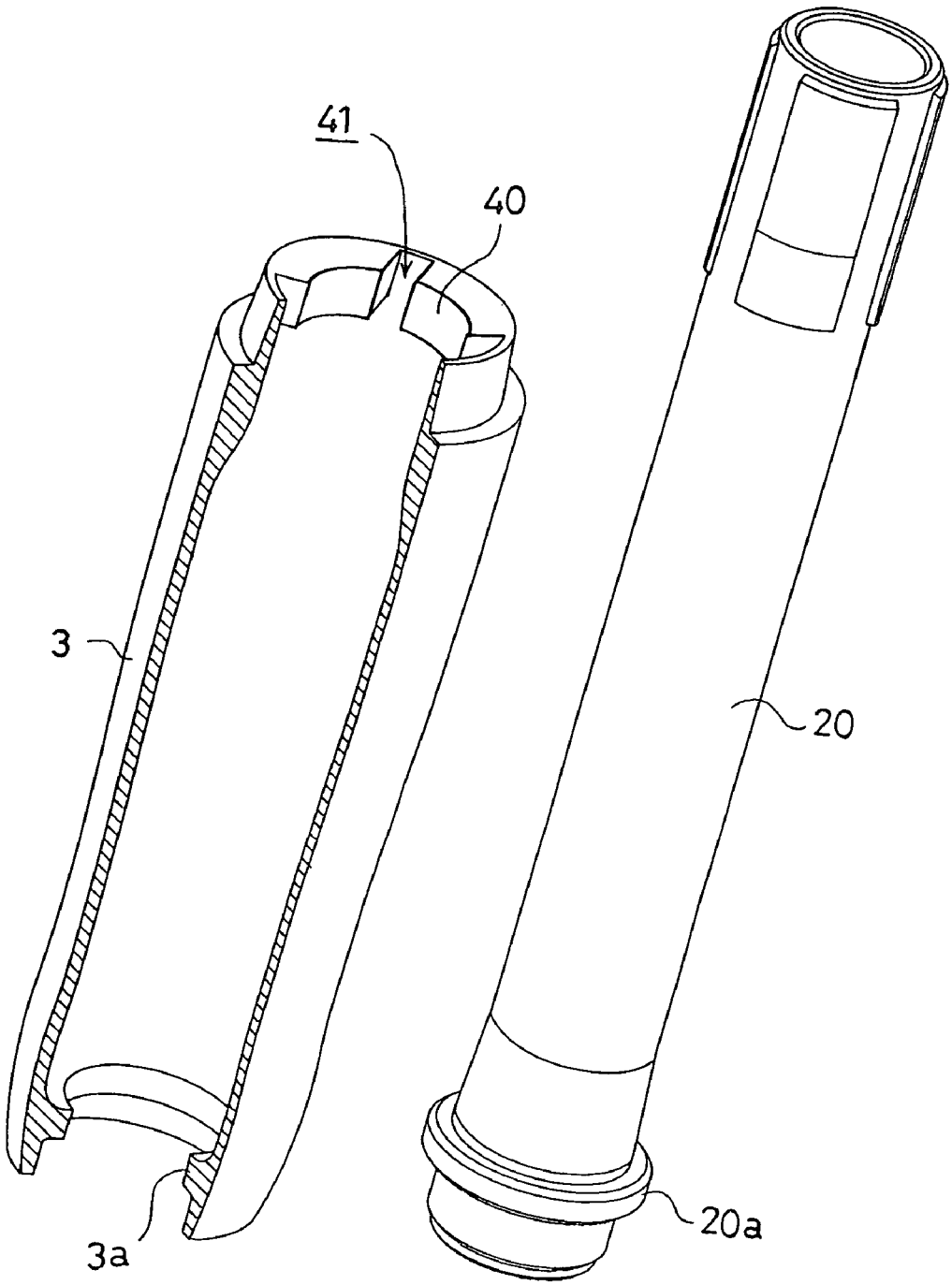
FIG. 7 is a perspective view of a front barrel portion of a mechanical pencil used as a writing implement in accordance with the second embodiment of the present invention.

In the second embodiment of the present invention, as shown in a longitudinal sectional view of FIG. 6 and a perspective view of FIG. 7, a centering member 40 is so provided as to project inward at three locations at the rear end side of the outer coat 3. As in the first embodiment, when the annular convex portion 3*a* of the outer coat 3 is brought into contact with the collar portion 20*a* of the front barrel 20, the outer coat 30 is positioned coaxially with the front barrel 20 by the centering members 40. Moreover, a gap between the centering members 40 provides the opening 41. Through this opening 41, the gel substance 4 can be injected into the space 15 between the outer coat 3 and the front barrel 20 as in the first embodiment.

(3) Third Embodiment

Figure 8:
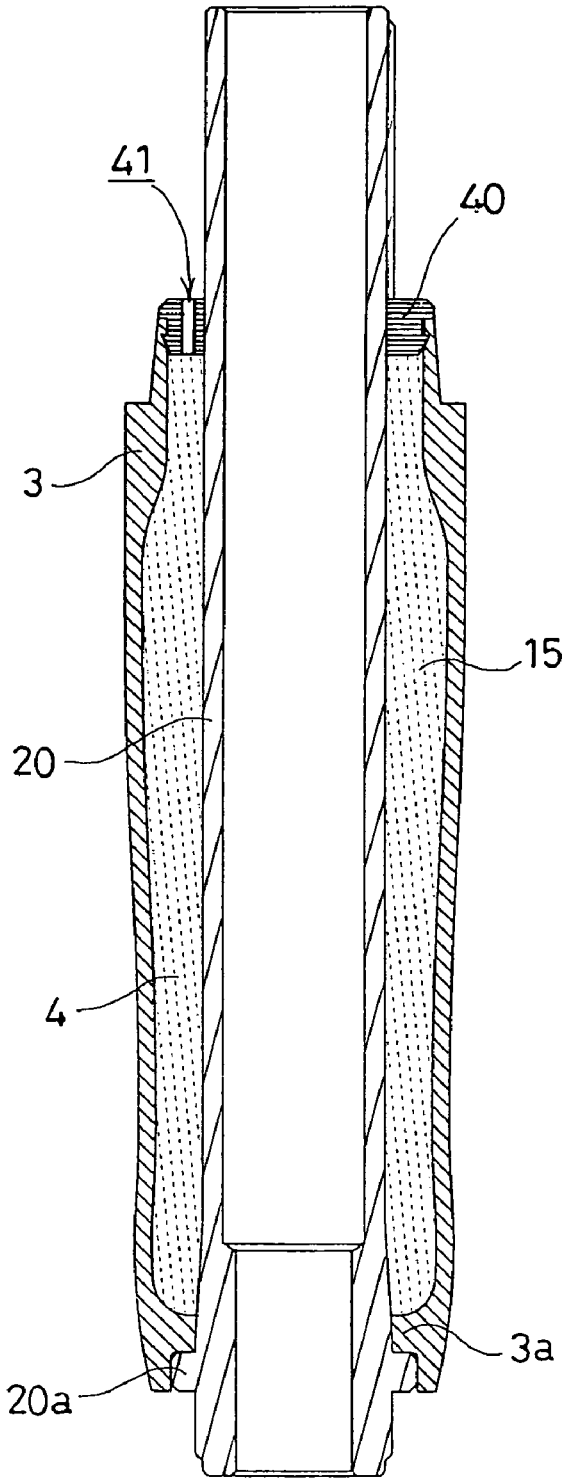
FIG. 8 is a longitudinal sectional view of a front barrel portion of a mechanical pencil used as a writing implement in accordance with the third embodiment of the present invention.
Figure 9:
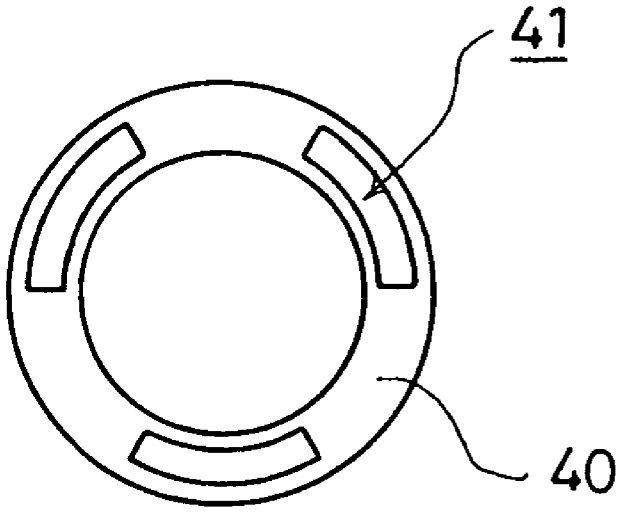
FIG. 9 is a plan view of a centering member in accordance with the third embodiment of the present invention.

In the third embodiment of the present invention, as shown in a plan view of FIG. 9, a ring-shaped centering member 40 is provided. This centering member 40 is formed with three openings 41 provided at equal intervals in the circumferential direction. As shown in FIG. 8, this centering member 40 is provided at a position on the rear end side of the front barrel 20 distant from the collar portion 20*a* through a length of the outer coat 3. As in the first embodiment, when the annular convex portion 3*a* of the outer coat 3 is brought into contact with the collar portion 20*a* of the front barrel 20, the rear end of the outer coat 3 comes into contact with the centering member 40. Thereby, the outer coat 3 is positioned coaxially with the front barrel 20 by this centering member 40. Moreover, through the opening 41 provided in the centering member 40, the gel substance 4 can be injected into the space 15 between the outer coat 3 and the front barrel 20 as in the first embodiment.

The present invention configured as described above achieves effects as described bellow.

According to the configuration of the first invention of the present invention, the grip provided in the grip portion of barrel of the writing implement is characterized by being formed of the gel substance capable of preserving its own shape. Because no liquid substance is used, there is no trouble of leaking of the substance in the grip portion even if the grip is damaged. Moreover, the grip feeling in the grip portion of the writing implement can be improved, and fatigue caused by long use can be decreased for the user.

According to the configuration of the second invention of the present invention, in addition to the effects of the first invention, there can be provided an outer coat structure such that the user does not directly touch a buffering substance, which improves the grip feeling and decreases fatigue, and the grip feeling can be prevented from being impaired by the outer coat structure.

According to the configuration of the third invention of the present invention, in addition to the effects of the second invention, there can be provided an eccentricity-preventing structure such that the outer coat structure and the buffering substance are not eccentric with respect to the grip portion of the writing implement.

According to the configuration of the fourth invention of the present invention, in addition to the effect of the third invention, measures can be taken so that the buffering substance can be injected into the eccentricity-preventing structure.

According to the configuration of the fifth invention of the present invention, in addition to the effects of the second invention, measures can be taken so that the buffering substance can be injected through the outer coat structure.

According to the configuration of the sixth invention of the present invention, in addition to the effects of the second invention, a structure can be provided in which the outer coat structure is not eccentric with respect to the grip portion of the writing implement, and also a structure can be provided in which the buffering substance can be injected.

According to the configuration of the seventh invention of the present invention, in addition to the effects of the second invention, the front end portion of the outer coat structure can be fixed surely to the barrel portion.

According to the configuration of the eighth invention of the present invention, in addition to the effect of the third invention, the rear end portion of the outer coat structure can be fixed surely to the barrel portion.

According to the configuration of the ninth invention of the present invention, in addition to the effect of the third invention, the front and rear end portions of the outer coat structure can be fixed surely to the barrel portion.

According to the configuration of the tenth invention of the present invention, in addition to the effects of the second, third, fourth, fifth, sixth, seventh, eighth, or ninth invention, the content of the writing implement can easily be seen from outside.

According to the configuration of the eleventh invention of the present invention, in addition to the effects of the second, third, fourth, fifth, sixth, seventh, eighth, or ninth invention, the outer coat can be effectively prevented from being turned up from the front end portion.

According to the configuration of the twelfth invention of the present invention, in addition to the effects of the eighth or ninth invention, the outer coat can be prevented effectively from being turned up from the rear end portion.

What is claimed is:

1. A writing implement having a grip structure in which a grip using a gel substance capable of preserving its own shape without the application of external forces thereto is provided in a grip portion of a barrel, comprising:

an outer coat covering the grip portion of the barrel, the gel substance being located between the outer coat and the barrel and coming in direct contact with the barrel; and a centering member for positioning the outer coat coaxially with the barrel between the outer coat and the barrel, the centering member being provided with an opening which allows a space between the outer coat and the barrel to communicate with the outside of the space.

2. A writing implement having a grip structure in which a grip using a gel substance capable of preserving its own shape without the application of external forces thereto is provided in a grip portion of a barrel, comprising an outer coat covering the grip portion of the barrel, the gel substance being located between the outer coat and the barrel and coming in direct contact with the barrel, the outer coat being provided with an opening which allows a space between the outer coat and the barrel to communicate with the outside of the space.

3. The writing implement according to claim 2, wherein the gel substance is formed by injecting a sol substance, which is a raw material, through the opening and by crosslinking the sol substance under a predetermined condition.

4. The writing implement according to claim 2, wherein an end of the outer coat is in contact with the whole circumference of the barrel, and another end of the outer coat is in contact with the barrel at three points.

5. The writing implement according to claim 4, wherein the gel substance is formed by injecting a sol substance, which is a raw material, through a gap between the outer coat and the barrel at an end where the outer coat is in contact with the barrel at three points and by crosslinking the sol substance under a predetermined condition.

6. The writing implement according to claim 2, wherein a collar portion annularly projecting towards outside is provided near the front end of the grip portion of the barrel;

an annular convex portion annularly projecting towards inside is provided on the internal surface near the front end of the outer coat; and the annular convex portion is in close contact with the collar portion.

7. The writing implement according to claim 2, wherein the barrel, the outer coat, and the gel substance are transparent.

8. The writing implement according to claim 2, wherein a writing point and a ferrule are provided at the front end of the barrel;

the front end portion of the outer coat is in contact with the ferrule; and the outside diameter of the outer coat in the contact portion is smaller than the outside diameter of the ferrule in the contact portion.

9. The writing implement according to claim 8, wherein the barrel, the outer coat, and the gel substance are transparent.

10. The writing implement according to claim 1, wherein the gel substance is formed by injecting a sol substance, which is a raw material, through the opening and by crosslinking the sol substance under a predetermined condition.

11. The writing implement according to claim 1, wherein the centering member is so provided as to project outward near the rear end of the grip portion of the barrel, and the rear end of the outer coat is in close contact with the centering member.

12. The writing implement according to claim 11, wherein a writing point is provided at the front end of the barrel;

the barrel is formed by a front barrel and a rear barrel;

the centering member is so provided as to project outward near the rear end of the grip portion of the front barrel;

the rear end of the outer coat is in close contact with the centering member; and a contact portion between the outer coat and the centering member is covered by the rear barrel when the front barrel is engaged with the rear barrel.

13. The writing implement according to claim 12, wherein the barrel, the outer coat, arid the gel substance are transparent.

14. The writing implement according to claim 1, wherein a collar portion annularly projecting towards outside is provided near the front end of the grip portion of the barrel;

the centering member is so provided as to project outward near the rear end of the grip portion of the barrel;

an annular convex portion annularly projecting towards inside is provided on the internal surface near the front end of the outer coat;

the annular convex portion is in close contact with the collar portion; and the rear end of the outer coat is in close contact with the centering member.

15. The writing implement according to claim 14, wherein a writing point is provided at the front end of the barrel;

the barrel is formed by a front barrel and a rear barrel;

the centering member is so provided as to project outward near the roar end of the grip portion of the front barrel;

the rear end of the outer coat is in close contact with the centering member; and a contact portion between the outer coat and the centering member is covered by the rear barrel when the front barrel is engaged with the rear barrel.

16. The writing implement according to claim 15, wherein the barrel, the outer coat, and the gel substance are transparent.

* * * * *